US008393021B2

(12) United States Patent
Stimpson et al.

(10) Patent No.: US 8,393,021 B2
(45) Date of Patent: Mar. 12, 2013

(54) ADAPTOR FOR A NON-FLEXIBLE FLOOR COVERING

(75) Inventors: Robert William Stimpson, Isle of Man (GB); Mark Luxton, Isle of Man (GB)

(73) Assignee: DLP Limited, Isle of Man (GB)

( * ) Notice: Subject to any disclaimer, the term of this patent is extended or adjusted under 35 U.S.C. 154(b) by 1192 days.

(21) Appl. No.: 11/915,868

(22) PCT Filed: Jun. 21, 2006

(86) PCT No.: PCT/GB2006/002256
§ 371 (c)(1),
(2), (4) Date: Nov. 29, 2007

(87) PCT Pub. No.: WO2007/003878
PCT Pub. Date: Jan. 11, 2007

(65) Prior Publication Data

US 2008/0196155 A1 Aug. 21, 2008

(30) Foreign Application Priority Data

Jul. 2, 2005 (GB) ..... 0513625.4

(51) Int. Cl.
*A47K 3/00* (2006.01)
*A47K 3/16* (2006.01)
*E04H 4/00* (2006.01)
*E04H 7/00* (2006.01)

(52) U.S. Cl. ..... 4/613; 4/592; 4/510; 4/506

(58) Field of Classification Search ..... 4/612–614, 4/252.6, 591–592, 13, 510, 513, 506; 52/716.1–716.8, 461, 35, 459, 465, 635
See application file for complete search history.

(56) References Cited

U.S. PATENT DOCUMENTS 3,667,177 A * 6/1972 Biela ..... 52/278
4,478,017 A * 10/1984 Brown et al. ..... 52/209
D380,528 S * 7/1997 D'Andrea ..... D23/283

(Continued)

FOREIGN PATENT DOCUMENTS

EP 0953310 11/1999
EP 1181883 2/2002

(Continued)

OTHER PUBLICATIONS

British Search Report for GB 0513625.4 (to which this case claims priority), Aug. 30, 2007.

(Continued)

*Primary Examiner* — Dinh Q Nguyen
*Assistant Examiner* — Chee-Chong Lee
(74) *Attorney, Agent, or Firm* — Fleit Gibbons Gutman Bongini & Bianco, PL; Paul D. Bianco; Martin Fleit

(57) ABSTRACT

A non-flexible floor covering adaptor is provided for use with a shower tray (10) having a peripheral trough (18) and means for engaging flexible floor covering material in the trough (18). The adaptor (30) comprises a first profiled portion (32) locatable in the trough (18) of the shower tray (10); a second profiled portion (34) which matches or substantially matches a peripheral edge of the shower tray (10), and a floor flange (36) for engagement with non-flexible floor covering material, such as tiles or boards.

18 Claims, 5 Drawing Sheets

U.S. PATENT DOCUMENTS

| | | | | |
|---|---|---|---|---|
| 5,756,176 | A * | 5/1998 | Feld | 428/48 |
| 6,357,192 | B1 * | 3/2002 | Schluter | 52/459 |
| 7,900,294 | B2 * | 3/2011 | Luxton et al. | 4/604 |
| 2005/0177936 | A1 * | 8/2005 | Graells Pane | 4/613 |

FOREIGN PATENT DOCUMENTS

| | | |
|---|---|---|
| EP | 1523914 | 4/2005 |
| GB | 2276317 | 9/1994 |
| GB | 2301030 | 11/1996 |
| GB | 2394175 A | 4/2004 |
| GB | 2407976 | 5/2005 |
| GB | 2427820 | 1/2007 |
| WO | WO2007003878 | 1/2007 |

OTHER PUBLICATIONS

International Search Report for PCT/GB06/002256, Jan. 9, 2006.
International Preliminary Report on Patentability for PCT/GB06/002256, Jan. 9, 2008.
Written Opinion for PCT/GB06/002256, Jan. 9, 2008.

* cited by examiner

ADAPTOR FOR A NON-FLEXIBLE FLOOR COVERING

FIELD OF THE INVENTION

This invention relates to an adaptor for use with a shower tray having a peripheral trough and means for clamping flexible floor covering material in the trough. In particular, the adaptor is specifically intended for use with non-flexible floor covering material.

BACKGROUND OF THE INVENTION

It is known from GB2394175A to provide a shower tray which comprises a trough along one or more sides of the tray and means for clamping flexible floor covering material in the trough. This type of shower tray has become extremely popular, since ft not only allows low-level or level-entry access to a handicapped, infirm or disabled person, but is also particularly straightforward to install and make watertight.

However, to date, this tray could only be used in conjunction with flexible floor covering material.

SUMMARY OF THE INVENTION

The present invention seeks to provide a solution to this problem, thereby allowing the shower tray to be used in conjunction with a non-flexible floor covering material, such as tiles or wood.

According to a first aspect of the present invention, there is provided a non-flexible floor covering adaptor for use with a shower tray having a peripheral trough and means for engaging flexible floor covering material in the trough, the adaptor comprising a first profiled portion locatable in the trough of the shower tray; a second profiled portion which matches or substantially matches a peripheral edge of the shower tray, and a floor flange for engagement with non-flexible floor covering material.

The phrase 'means for engaging is intended to mean any means by which two surfaces are engaged, and is specifically intended to cover clamping by which two surfaces are physically urged or forced together in order that securing via clamping is realised.

Preferable and/or optional features of the first aspect of the invention are set forth in claims 2 to 8, inclusive.

According to a second aspect of the present invention, there is provided a method of installing a shower tray using an adaptor in accordance with the first aspect of the invention, the method comprising the steps of: a) positioning a shower tray having a peripheral trough and means for engaging flexible floor covering material in the trough in or on a surface to be covered with non-flexible floor covering material; b) locating one or more of the adaptors on the periphery of the shower tray so that the floor flange lies on the surface of the floor to be covered; and c) laying non-flexible floor covering material on the floor such that the floor flange is securely trapped between the floor covering material and the floor; and engaging the first profiled portion of the adaptor in the trough.

Preferably and/or optionally, in step (c), the engaging means of the shower tray includes a clamping element, and the first profiled portion of the adaptor is clamped in the trough using the clamping element.

BRIEF DESCRIPTION OF THE DRAWINGS

The present invention will now be more particularly described, by way of example only, with reference to the accompanying drawings, in which.

DETAILED DESCRIPTION OF THE INVENTION

Figure 1:
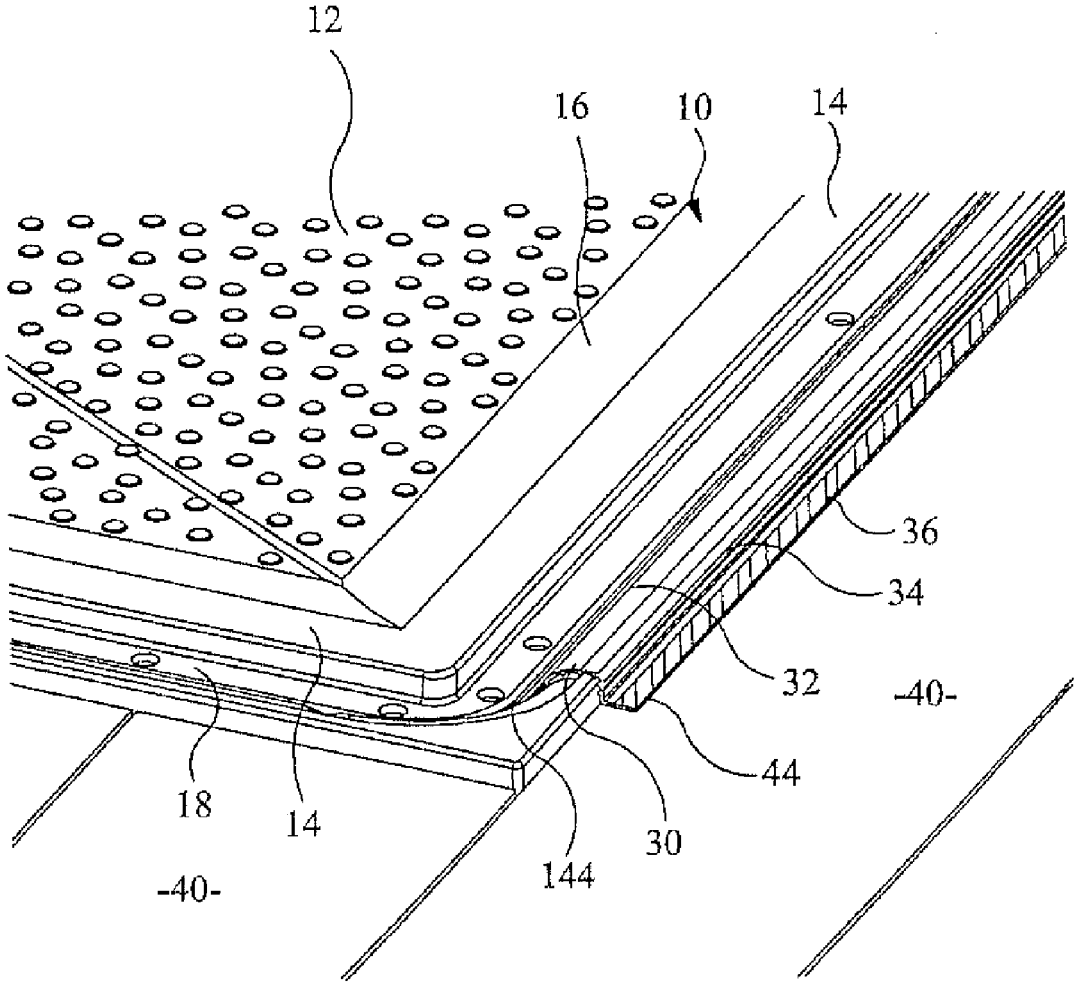
FIG. 1 is a scrap isometric view from above one corner of a shower tray recessed within floorboards and showing one embodiment of a side adaptor, in accordance with the first aspect of the invention, positioned on a first side of the shower tray.

Referring to the drawings, there is shown part of a shower tray 10 which is known from GB2394175A. The shower tray 10 is provided with sloping upper surface facets 12 of varying shapes and slopes combining to direct water which may be impinging upon them (not shown) to a waste outlet (not shown). Surrounding the sloping upper facets is a horizontal flat surface 14 which is linked to them by interfacing transitional facets 16. The horizontal flat surface 14 provides a surface onto which shower enclosure screens (not shown) may achieve a water resistant seal. External to the flat surface 14 is a particularly shaped trough 18, which is shown extending along two sides of the shower tray 10. The trough 18 can extend continuously around the shower tray 10, or may only extend along one or more sides depending upon where the shower tray 10 is to be located. Although the shower tray 10 is quadrilateral other shapes, both circular and non-circular are envisaged.

The outer edge 20 of the shower tray 10 includes a substantially vertical face. The outer side 22 of the trough 18 slopes in a blended manner from the outer edge 20 of the shower tray 10 towards the base 24 of the trough 18. The inner side 26 of the trough 18 is stepped to receive a screw-down clamping bar 28. If the trough 18 is provided along more than one side of the shower tray 10, the inner and outer sides 22 and 26 of the trough 18 extend around the or each corner of the shower tray 10 in a seamless blended fashion.

Further details of the shower tray 10, known from GB2394175A, are omitted.

A non-flexible floor covering adaptor 30 for use with this shower tray 10 is shown in the drawings. The adaptor 30 comprises a first portion 32 which is profiled to match or substantially match the blended in-sloping outer side 22 of the trough 18 of the shower tray 10, a second portion 34 which is contiguous with the first profiled portion 32 and which is profiled to match or substantially match the outer peripheral edge 20 of the shower tray 10, and an externally projecting planar or substantially planar floor flange 36 which is contiguous with the second profiled portion 34.

Figure 5:
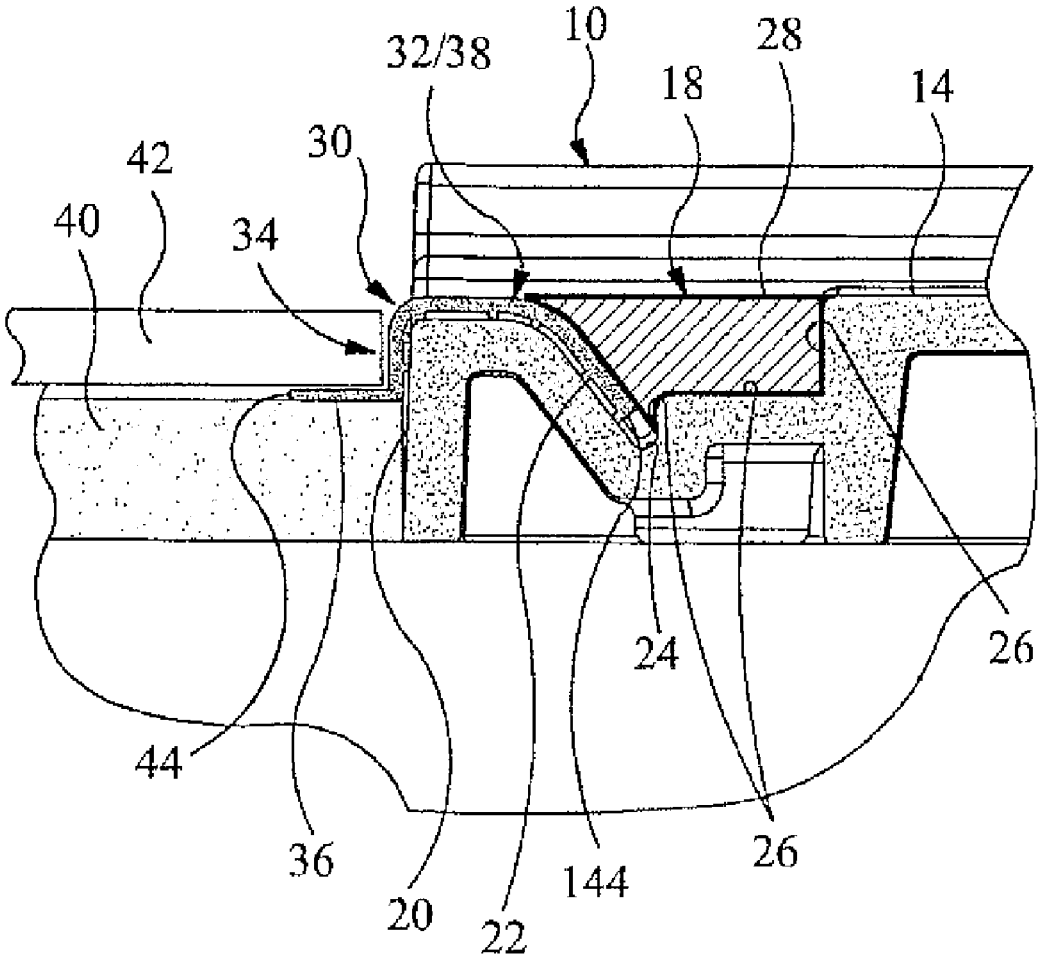
FIG. 5 shows an enlarged fragmentary sectional view taken along a plane perpendicular to the peripheral side edge of the shower tray.

As best seen in FIG. 5, the first portion 32 is in the form of a thin lip element 38 which extends into the trough 18 of the shower tray 10 along the outer side 22. The known screw-down clamping bar 28 of the shower tray 10 is then used as the sole means for engaging the adaptor 30 with the shower tray 10.

The depth of the second portion 34, and thus the relative positioning of the floor flange 36, depends upon whether the shower tray 10 is to be recessed within the surrounding floor area 40, to provide full level-entry access, or positioned on the floor area to provide low-level access. The floor flange 36, in use, must lie in contact with the surrounding floor 40. Consequently, the second portion 34 will extend the fall depth of the outer edge 20 of the shower tray 10 or, as shown in FIG. 1, only part thereof.

Figure 2:
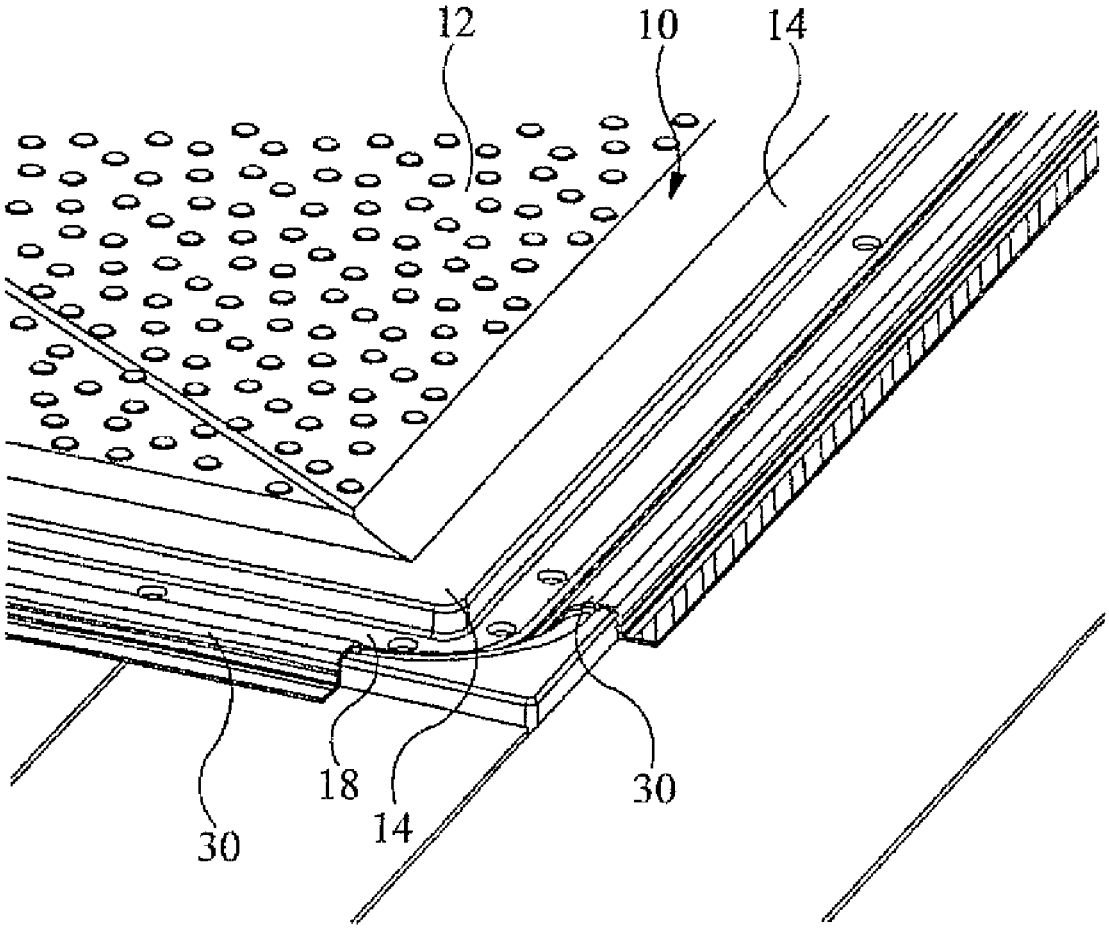
FIG. 2 is a view similar to that of FIG. 1, showing another side adaptor positioned on a second side of the shower tray.

Two side adaptors 30 shown in FIGS. 1 and 2 are typically extruded from aluminium or other metal, or plastics material.

Figure 3:
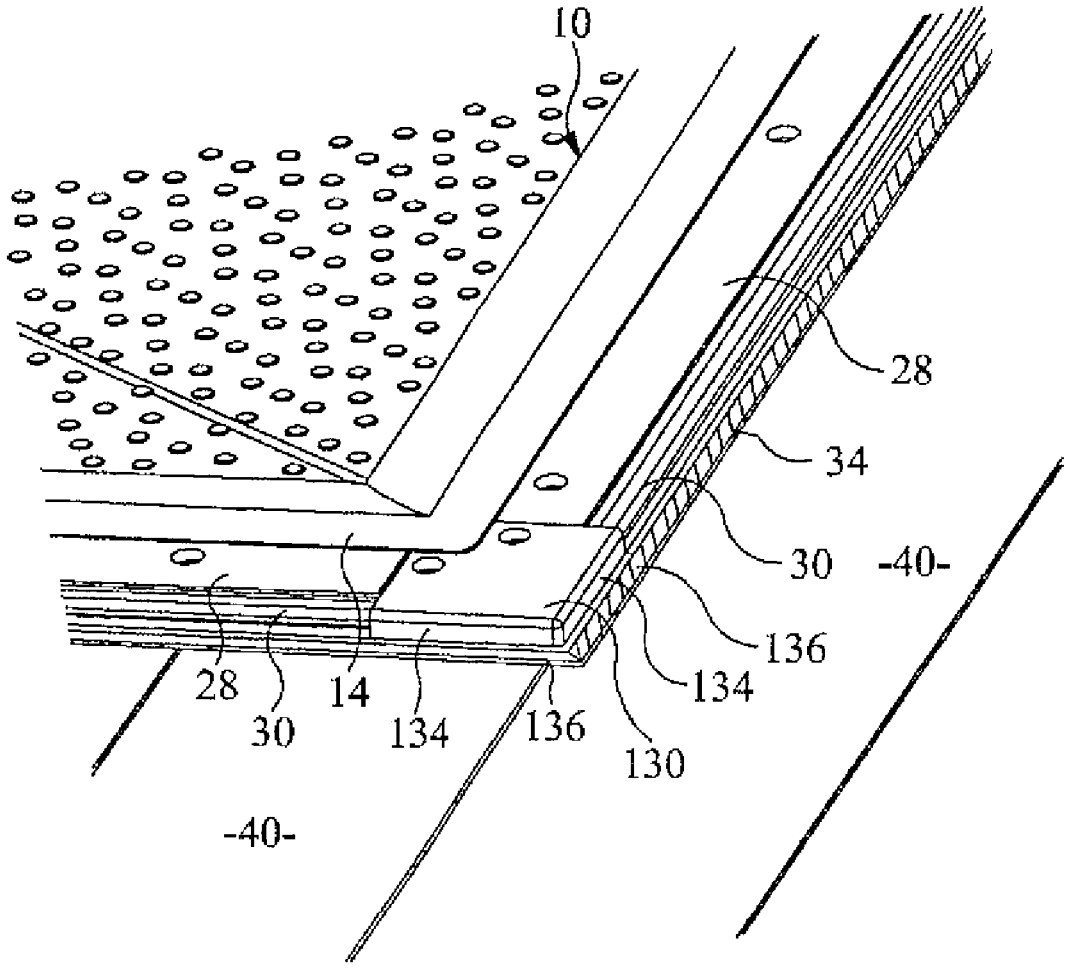
FIG. 3 shows a corner adaptor, in accordance with the first aspect of the invention, positioned on the corner of the shower tray, between the two side adaptors, and clamping bars in the trough.
Figure 4:
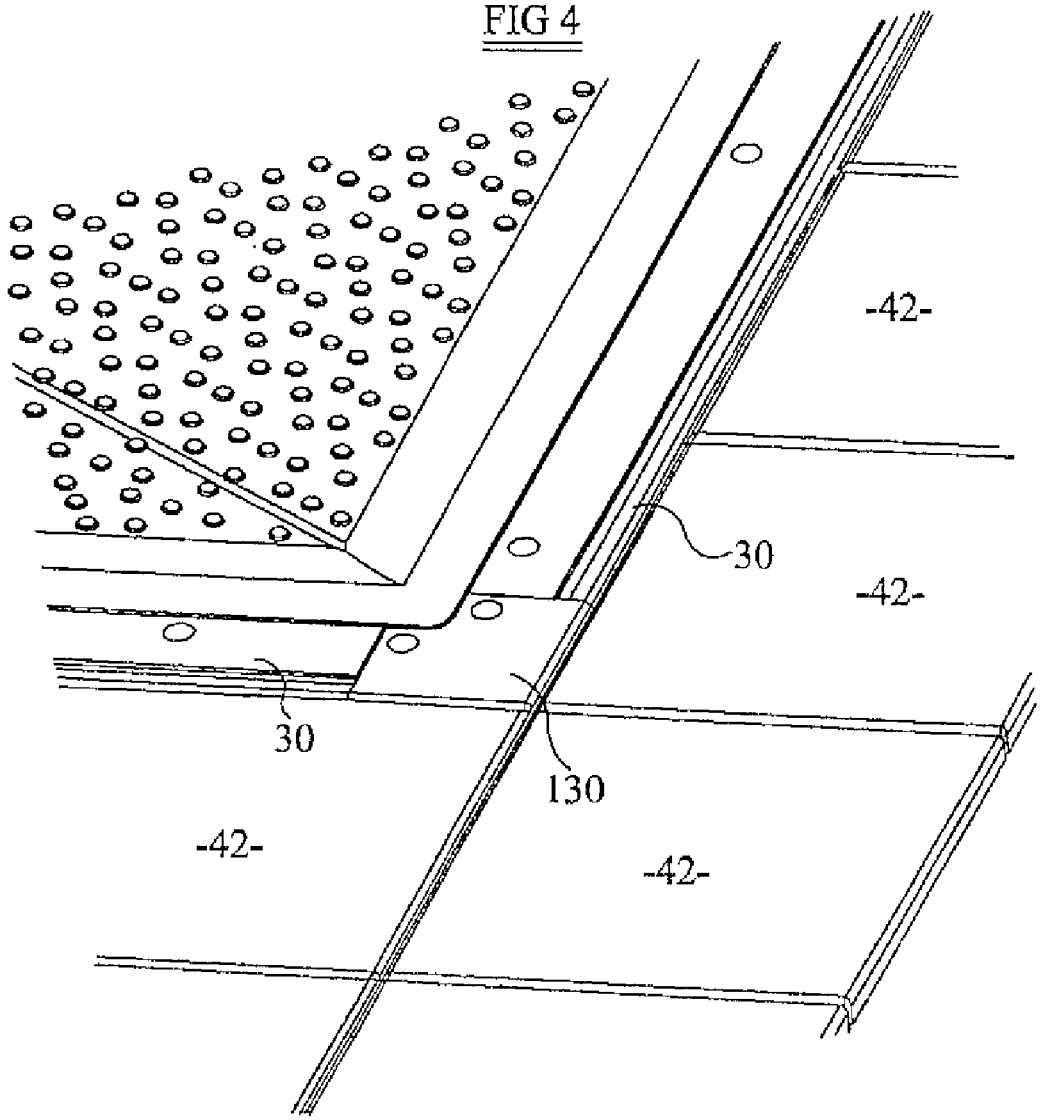
FIG. 4 shows screw caps in place on the clamping bars and tiles covering the floorboards.

A corner adaptor 130 is shown in FIG. 3. The corner adaptor 130 bridges a corner and is interposed between two adjacent side adaptors 30. The corner adaptor 130 includes a second profiled portion 134 and a floor flange 136. However, the first profiled portion 132 of the corner adaptor 130 is altered to seat in and extend across the trough 18, allowing a discrete clamping bar adapted for insertion at the corner of the shower tray 10 to be dispensed with. The corner adaptor 130 is held in place either by being overlapped with adjacent clamping bars, or via engaging means, such as screw-threaded fasteners or bonding.

The corner adaptor 130 is typically moulded from plastics material.

Once the adaptors 30 and 130 are positioned on the periphery of the shower tray 10, bridging the join between the shower tray 10 and the floor 40, tiles 42 can then be secured to the floor area 40 up to and over the floor flange 36 and 136 of the or each adaptor 30 and 130. As a result, two longitudinal edges 44 and 144 of the or each adaptor 30, 130 are trapped by the tiles 42 and the clamping bar 28, respectively. Water proofing material (not shown) can then be run along any gaps or joins as necessity dictates, to water-tightly seal the tiles 42 to the adaptors 30, 130 and adjacent adaptors 30, 130 to each other.

Although tiles are suggested, other non-flexible flooring covering materials can also be used, such as wood.

In the above-described embodiment, the first profiled portion is lip-like. However, the first profiled portion can be shaped similarly to the clamping bar, thus dispensing with the need for a discrete or separate clamping bar. In this case, the first profiled portion has a profiled lower surface which fits in the trough, and a planar or substantially planar upper surface which aligns or substantially aligns with the horizontal flat surface of the shower tray. The first profiled portion of the adaptor is directly screwed or otherwise directly or indirectly fastened, such as by bonding, push-fit engagement or snap-fit engagement, to the trough.

It is thus possible to provide an adaptor which allows a shower tray, heretobefore used in conjunction only with flexible floor covering material, such as Altro®, to be used also in conjunction with non-flexible floor covering material, such as tiles and wood.

The term 'trough' is intended to mean any channel, recess or rebate formed in, at or adjacent to a peripheral edge of the shower tray. The trough, for example, can have a U-shaped, C-shaped, or L-shaped lateral cross-section.

Although a screwed clamping bar is suggested, a push-fit or snap-fit clamping bar or clamping bar can be utilised, with or without screw-threaded fasteners.

Any clamping element, instead of a clamping bar, can be used. Alternatively and/or additionally, engagement of the adaptor with the shower tray can be by bonding or by any other suitable engagement means.

The embodiments described above are given by way of examples only, and further modifications will be apparent to persons skilled in the art without departing from the scope of the invention as defined by the appended claims.

The invention claimed is:

1. A non-flexible-floor covering adaptor for use with a shower tray having a peripheral trough, the adaptor comprising:

a first profiled portion located in or across the trough of the shower tray;

a second profiled portion which matches or substantially matches a peripheral edge of the shower tray;

a floor flange having an upper surface engaging with a non-flexible floor covering material; and an elongated clamping member having an upper surface, the clamping member positioned over said first portion and within said peripheral trough thereby securing the adaptor to the trough, wherein said second portion and the upper surface of said clamping member are substantially co-planar to provide for low-level or entry-level access between the non-flexible floor covering material and the shower tray.

2. The adaptor as claimed in claim 1, wherein the first profiled portion is in the form of a lip element which can extend around an edge of, and into, the trough for engagement by the engaging means of the shower tray.

3. The adaptor as claimed in claim 1, wherein the floor flange extends in a direction which is opposite that of the first profiled portion.

4. The adaptor as claimed in claim 1, wherein the floor flange is shaped flat and elongated for extending beneath the non-flexible floor covering material.

5. The adaptor as claimed in claim 1, wherein lateral profiles of the first and second portions of the adaptor are shaped to complementarily match or substantially match a profile of the periphery of the shower tray.

6. The adaptor as claimed in claim 1, wherein the adaptor has a rectilinear longitudinal extent.

7. The adaptor as claimed in claim 1, wherein the adaptor is non-rectilinear for extending around sides defining at least in part a showering area of the shower tray.

8. The adaptor as claimed in claim 1, wherein the adaptor is held to the shower tray solely by the engaging means.

9. The adaptor according to claim 1, wherein the floor flange is substantially planar and substantially parallel to the second portion and the upper surface of the clamping member.

10. The adaptor according to claim 1, wherein the floor flange extends underneath the non-flexible floor covering material.

11. A method of installing a shower tray using a non-flexible-floor covering adapter comprising a first profiled portion located in or across a trough of the shower tray; a second profiled portion which matches or substantially matches a peripheral edge of the shower tray, and a floor flange having an upper surface engaging with a non-flexible floor covering material, the method comprising the steps of:

a) positioning the shower tray having a peripheral trough and means for engaging flexible floor covering material in the trough in or on a surface to be covered with non-flexible floor covering material;

b) locating at least one of the adaptors on a periphery of the shower tray so that the floor flange lies on the surface of the floor to be covered; and c) laying non-flexible floor covering material on the floor such that the floor flange is securely trapped between the floor covering material and the floor; and engaging the first profiled portion of the adaptor in the trough.

12. The method as claimed in claim 11, wherein, in step (c), the engaging means of the shower tray includes a clamping element, and the first profiled portion of the adaptor is clamped in the trough using the clamping element.

13. A non-flexible-floor covering adaptor for providing level-entry access or low-level access between a floor covering material and a shower tray having a horizontal flat surface, an outer edge, and a peripheral trough defined between said flat surface and said outer edge, comprising:

a first portion located within said trough and substantially conforming to at least a portion of a surface configuration of said trough;

a second portion which substantially conforms to at least a portion of said outer edge;

a floor flange portion having an upper surface positioned under the floor covering material; and an elongated clamping member positioned over said first portion and within said peripheral trough, and including one or more clamp elements to secure the adaptor to the shower tray, wherein the clamping member, adaptor, and said flat surface are all positioned such that the floor surface is substantially co-planar with said shower tray thereby enabling substantially unobstructed access for a person to pass from the floor covering to the shower tray.

14. The adaptor according to claim 13, wherein the first profiled portion has a lip element which can extend around an edge of, and into, the trough for engagement by the engaging means of the shower tray.

15. The adaptor according to claim 13, wherein said outer edge is substantially vertical.

16. The adaptor according to claim 13, wherein the sole means for engaging said adaptor with said shower tray is through positioning of said clamping member in said trough.

17. The adaptor according to claim 13, wherein the floor flange extends in a direction which is opposite that of the first profiled portion.

18. The adaptor according to claim 13, wherein the floor flange is substantially planar and parallel to the clamping member, the adaptor, and the flat surface.

* * * * *